United States Patent [19]

Bartsch

[11] 4,321,289

[45] Mar. 23, 1982

[54] METHOD OF AND APPARATUS FOR THE CLADDING OF STEEL SHEET OR STRIP WITH LOWER MELTING METALS OR ALLOYS

[75] Inventor: Adalbert Bartsch, Marxen, Fed. Rep. of Germany

[73] Assignee: Norddeutsche Affinerie Aktiengesellschaft, Hamburg, Fed. Rep. of Germany

[21] Appl. No.: 181,156

[22] Filed: Aug. 22, 1980

[30] Foreign Application Priority Data

Sep. 14, 1979 [DE] Fed. Rep. of Germany ..... 2937188

[51] Int. Cl.[3] ..... C23C 1/00; C23C 1/14

[52] U.S. Cl. ..... 427/287; 427/292; 427/309; 427/313; 427/319; 427/367; 427/398.2; 427/405; 427/432; 118/59; 118/68; 118/69; 118/101; 118/106; 118/122; 118/413; 118/415; 164/461; 164/478

[58] Field of Search ..... 164/83, 86, 87, 88, 164/98, 100, 103; 427/360, 367, 432, 287, 292, 309, 319, 405, 313, 398.2; 118/414, 413, 415, 69, 68, 59, 106, 122

[56] References Cited

U.S. PATENT DOCUMENTS

| | | | |
|---|---|---|---|
| 1,841,297 | 1/1932 | Perry et al. | 164/87 |
| 3,545,530 | 12/1970 | Clochetto | 164/83 |
| 3,860,057 | 1/1975 | Garlick | 164/87 |
| 4,071,643 | 1/1978 | Pratt et al. | 427/433 |
| 4,152,471 | 5/1979 | Schnedler et al. | 427/310 |

FOREIGN PATENT DOCUMENTS 1356782 6/1974 United Kingdom .

*Primary Examiner*—Ralph S. Kendall
*Attorney, Agent, or Firm*—Karl F. Ross

[57] ABSTRACT

A cladding process and apparatus in which steel strip or sheet is cladded with a metal of lower melting point, e.g. lead, by maintaining a bank of constant level of the molten cladding material between a belt and the strip or sheet substrate which passes along an inclined path and is cooled to harden the molten material thereon. During the cooling process the applied material is compressed against the substrate.

14 Claims, 2 Drawing Figures

METHOD OF AND APPARATUS FOR THE CLADDING OF STEEL SHEET OR STRIP WITH LOWER MELTING METALS OR ALLOYS

FIELD OF THE INVENTION

My present invention relates to a method of and to an apparatus for the cladding of steel strip or sheet with lower melting metals or their alloys and, more particularly, to a cladding process in which a molten metal or an alloy is applied to and bonded to the substrate.

BACKGROUND OF THE INVENTION

Strip steel or sheet steel can be coated with lower melting metals, e.g. lead, by applying the molten metal to the steel substrate and permitting the molten metal to cool as a layer on the substrate and bond thereto.

Methods of cladding steel in this manner generally apply the molten metal to the steel strip or sheet substrate while the latter is inclined to the horizontal and induce solidification of the coating by forced cooling of the substrate and the applied materials.

In the system of German Pat. DE-PS No. 718,528, for example, the strip or sheet is passed through a channel which is inclined to the horizontal and into which the molten metal is poured.

In British Pat. No. 1,356,782, the material is applied from a funnel to the inclined substrate.

Both processes have been found to have a common disadvantage in that the feed of the substrate and the cooling of the applied molten material must be carefully coordinated and controlled with high precision if defects in the coating are to be excluded and malfunctions in the operation of the process are to be avoided.

Another disadvantage, particularly in the case of the system of German Pat. No. 718,528, is that the substrate to be coated, or the coating material, is limited as to the shape, extent or parameters of the cladding layer which can be fabricated.

It is known also to clad sheet or strip steel with lead (German patent document—Open Application DE-OS No. 20 08 454), introducing the substrate at an acute angle to the horizontal, from above, into a bath of molten lead overlain by a slag layer and then to draw the substrate, with the lead adhering thereto, through a die of appropriate shape determining the thickness of the cladding layer or layers.

Experience has shown that lead baths of this type suffer segregation and tend to develop inhomogeneities which may affect the coating.

Consequently, even after only a matter of hours, especially in the case of copper-alloyed lead, it is necessary to interrupt the operation, clean and empty the entire apparatus and then refill it before beginning again the cladding process.

Because of the time-consuming nature of the cleaning operation and the downtime of the apparatus during the cleaning procedure, this system has serious economic handicaps.

If cleaning is not carried out after sufficiently short intervals of cladding operation, the segregation brings about nonuniform coatings which result in warping and in irregular cladding.

Furthermore, experience has shown that the apparatus used in this system has disadvantages apart from those enumerated above in that, for example, it is difficult to satisfactorily seal the die against the leakage of lead and to restart the operation after the latter has been interrupted as is required after each cleaning sequence.

Finally, in connection with this arrangement it is noted that the system requires strong tensile forces to draw the substrate through the bath and the die, these forces frequently giving rise to differential changes in length between the lead layer and the substrate causing structural complications at the interfaces and in critical zones where bonding is required.

OBJECTS OF THE INVENTION

It is the principal object of the present invention to provide an improved method of cladding steel strip or sheet with lower melting metals or alloys whereby the disadvantages of earlier systems are obviated.

Another object of this invention is to provide an improved method of applying coatings of low-melting materials to a steel substrate which can be carried out continuously and with a minimum of interruption, yielding an effectively bonded coating on the substrate which is homogeneous, uniform and free from cracks or like discontinuities.

Still another object of the invention is to provide an improved but relatively simple apparatus for the cladding of steel strip or sheet with low melting metals or alloys which permits fine control of the process but yet does not require as critical a control of the substrate feed and cooling as do conventional processes.

SUMMARY OF THE INVENTION

These objects and other which will become apparent hereinafter are attained, in accordance with the present invention, in a method of cladding steel strip or sheet (hereinafter a steel substrate) with a lower melting metal or alloy (material) wherein the substrate is passed at an inclination to the horizontal and the molten metal is retained against the substrate by an endless belt which, at least over part of its path, is parallel to the surface of the substrate to be cladded, the molten material being laterally retained by sliding shoes which can rest upon the substrate.

According to the invention, moreover, in the region in which the molten material is initially applied to the substrate, a reducing atmosphere is maintained, thereby ensuring the monogeneity of the bank of molten material which progressively feeds the layer by passing between the endless belt and the surface of the substrate juxtaposed therewith.

The inclination of the substrate is ensured by a roller array upon which the opposite surface thereof rests and this array can be adjustable to vary the inclination at any angle between 30° to 70° to the horizontal although an angle of about 45° is preferred.

Because the distance between the endless belt and the substrate is adjustable, the thickness of the cladding layer can be selected within a wide range depending upon market requirements. Preferred thicknesses are 2 to 20 mm although both smaller and larger thicknesses can be used if desired.

As indicated, between the surface of the substrate to be clad with the molten metal and the downwardly turning portion of the endless belt, which may be composed of a material unaffected by the molten material and nonadherent thereto, there is provided a bank of the molten material which is held constant and preferably as small as possible and as close as possible to the upper direction-change roller of the belt-guidance system. A sensor, e.g. an optical device, can be provided to control the flow of molten metal to this bank.

Advantageously, this upper roller and the bank of molten metal is disposed within a hood or other enclosure retaining the reducing gas blanket which prevent oxidation of the molten material.

Advantageously, this reducing gas blanket is maintained by combustion in this zone at a substoichiometric ratio with respect to a hydrocarbon fuel.

Thus if the air/fuel ratio $\lambda=1$ represents a stoichiometric amount of atmospheric oxygen sufficient to combust completely all of the fuel (to $CO_2$ and $H_2O$), we prefer to use an air ratio $\lambda$ between 0.90 and 0.95 to maintain a reducing atmosphere. This, of course, corresponds to 5 to 10% less oxygen than is required to completely burn all of the fuel.

The combustion is preferably carried out with burners spaced apart across the width of the substrate and trained against the molten material which is applied thereto. We have found it to be advantageous to feed the fuel and air at such velocity that the flame cones from the burners penetrate to a depth of 3 to 15 mm (approximately) into the molten material of the bank formed on the substrate.

This additional heating results in a significant improvement of the bond of the molten material to the substrate, probably as a result of the combination of the additional heating with agitation caused by the jets emerging from the burners.

The length, orientation or position and speed of the endless belt can be selected, according to another feature of the invention, so that kneading of the molten metal layer and the solidifying layer occurs during the solidification process. At least some kneading is desirable when the solidification has progressed to the point that the molten material has doughy consistency. For example, this may result by making the speed of the belt somewhat greater than the speed of the substrate and/or by pressing portions of the belt between the direction-change rollers, more deeply into the layer than elsewhere.

The kneeding of the molten material appears to result in a compaction of the cladding layer, an improvement in the metallurgical structure of this layer and a reduction in structural defects. Cracks which have appeared in other cladding systems are excluded with the system of the invention and greater structural integrity is assured.

We have found it to be advantageous to position the sliding shoes which laterally confine the layer of molten material between the belt and the substrate, so that the cladding is applied short of the edges of the substrate, i.e. an uncladded zone is formed along each longitudinal edge of the substrate to a width of, say, up to 5 cm. This has been found to be particularly desirable when the clad substrate is used in the fabrication of larger bodies and welding along the longitudinal edges is desirable.

The substrate can be pretreated in a conventional manner. For example, it can be subjected to a coarse cleaning to remove scale by sandblasting, shot peening or steel-grit blasting, the coarse mechanical descaling being followed by a pickling treatment preferably in such manner that the evolution of hydrogen is excluded or minimized.

It has been found to be advantageous to spray a liquid pickling agent from a nozzle array onto the substrate of a minimum length thereof and to thereafter treat the surface with jets of steam to remove the pickling solution and effect final cleaning with a minimum tendency to reoxidation of the surface.

In yet another feature of the invention, after the cleaning in the manner described, a primer or bond promotor can be applied to the surface of the substrate to be cladded with the molten material. The primer, which can be a metal alloy, also serves to protect the surface of the steel from oxidation.

The substrate can be supplied to the cladding stage at an elevated temperature resulting from the heating during application of the alloyed primer although, in any event, it is desirable to heat the substrate to a temperature close to that of the molten material before it reaches the molten material. This yields a particularly effective bond and adhesion of the cladding layer to the substrate.

After the molten material is applied to the substrate, forced cooling is indirectly carried out, e.g. by means of cooled rolls, and most advantageously within the zone of contact of the endless belt by directing a cooling fluid such as water or compressed air to the uncoated underside of the substrate.

Direct cooling of the endless belt on its side turned away from the substrate may also be effected. The belt can thus be composed of a metal, e.g. stainless steel, or some other material to which the cladding material or alloy does not readily adhere.

The process of the present invention has widespread application and can be used to apply virtually all metals and alloys which have a lower melting point than that of steel to the strip or sheet substrate.

The preferred cladding materials are lead or copper or their alloys and the primer can be tin, a tin-lead alloy (solder), if the substrate is to be cladded with lead or a lead alloy, or silver solder if the substrate is to be cladded with copper or copper alloy.

When tin or a tin-lead alloy is applied as the primer, a suspension of powder thereof in a liquid flux can be applied to the preheated or concurrently heated substrate.

The method of the present invention can be carried out continuously with inspection and access to the product during the coating process being available at all times. The substrate can utilize practically any width and gauge of steel strip or sheet and the process can be carried out with a linear speed, depending upon the thickness of the cladding layer, which can be as high as 40 m/min.

BRIEF DESCRIPTION OF THE DRAWING

The above and other objects, features and advantages of the present invention will become more readily apparent from the following description, reference being made to the accompanying drawing in which.

SPECIFIC DESCRIPTION AND EXAMPLE

Figure 1:
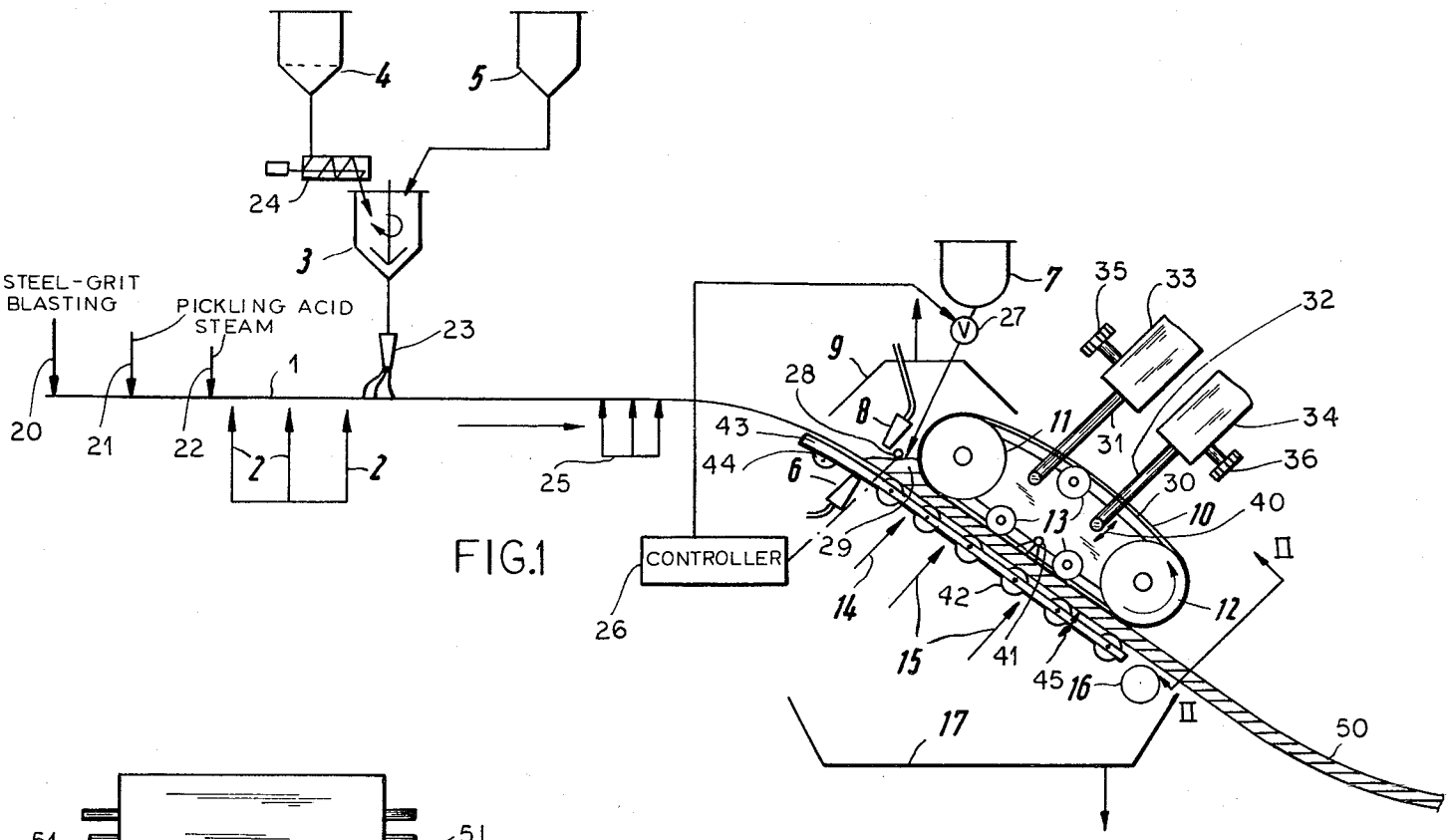
FIG. 1 is a flow diagram illustrating the cladding of steel sheet or strip with lead.
Figure 2:
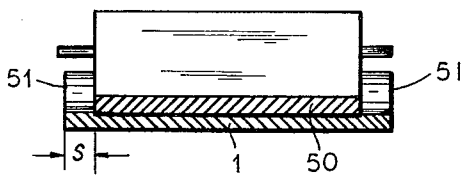
FIG. 2 is a transverse cross section taken along the line II—II of FIG. 1.

In the drawing I have shown a steel strip 1 which is fed along a transport path in which it can be subjected, on its upper surface, to steel-grit blasting at 20, a brief spraying of hydrochloric acid as a pickling agent at 21 so that hydrogen evolution is minimized or excluded and blowing and final cleaning with steam jets 22.

The strip is then heated by three arrays of burners 2, each spray being a row of burners spaced apart across the width of the strip (perpendicular to the plane of the paper in FIG. 1)and trained upon the underside of the strip.

The thus-heated strip is then sprayed via a nozzle 23 with an agitated tin-lead powder in a liquid flux from a mixing tank 3 to which the liquid flux is supplied from a reservoir 5 and the tin-lead is supplied from a fluidized bed storage vessel 4, e.g. via a worm conveyor 24 forming a metering device.

The strip is subsequently heated, e.g. by burner arrays 25 to a temperature above the melting point of the priming alloy and preferably close to the melting point of the cladding layer.

The strip steel then enters the cladding zone in which it is heated by a row of burners 6 to the cladding temperature for the lead (about 350° C.), the lead being supplied from a molten-lead storage vessel 7 via a valve 27 responsive to a controller 26 which receives input from a sensor 28 detecting the level of the bank of molten layer upstream of the endless belt 10 and the direction-change roller 11.

The supply of the molten material is thus limited to maintain the low bank 29 thereof.

Within a hood 9 in this region of the coating device, the burners 8, likewise spaced across the width of the strip, are provided to maintain a slightly reducing atmosphere which excludes air from the region of the hood and prevents oxidation of the molten material.

The endless belt 10 passes around the direction-change rollers 11 and 12 which, together with backing rollers 13, are mounted on a support 30 which is pivotally connected to a pair of arms 31 and 32 held in the stationary sleeves 33 and 34 by setscrews 35 and 36 which allow the distance between the substrate and the lower pass of the belt to be adjusted and also allow the angle of inclination of the belt to be adjusted as represented by the arrow 40.

The thickness of the cladding layer will thus depend on the position of this belt.

The stainless steel belt is cooled on its internal surface by the direct spray of water from nozzles 41 and by circulating cooling water through the rollers 13.

The substrate, along its inclined stretch, is supported on an array of rollers 42 which are mounted on a common frame 43 pivoted at 44 to the machine stand so that the angle of tilt can be correspondingly adjusted as represented by the arrow 45.

At least the lower group of these rollers can be cooled by water as well.

Forced cooling is also effected by blowing air unto the substrate, eg. via nozzles 14 and/or by spraying water onto the reverse side of the substrate from nozzles 15. The cooling water, collected by means of a stripper 16 and a collecting tank 17, can be cooled in a heat exchanger and recirculated to the spray nozzles.

In operation, the molten metal is pressed against the substrate by the endless belt 10 and congeals to form the layer 50 which can pass through quality control stations before the strip is cut into sheets of desired size.

A pair of shoes 51 flank the layer 50 as it cools and define edge zones s free from the cladding.

I claim:

1. A method of cladding a steel strip substrate with a molten material having a melting point less than that of steel, comprising the steps of:

(a) feeding said substrate downwardly along a path inclined to the horizontal while supporting said substrate along said path;

(b) depositing molten material between an upper surface of said substrate and a juxtaposed endless belt surface continuously moving in the direction of movement of said substrate and parallel thereto while laterally confining the molten material between said surfaces between a pair of sliding shoes, the inclination of said surfaces along said path being between 30° and 70° to the horizontal, said belt surface approaching said upper surface of the substrate strip at an upper end of said path to form a bank of said molten material at said upper end, said belt surface exending away from said upper surface of said substrate at a lower location along said path, said substrate continuing along said inclined path below said location;

(c) cooling the molten material between said surfaces along said path to apply a cladding layer of said material in solidified form to said surface of said substrate and bond said layer to said substrate; and (d) maintaining the region of contact of said belt surface with said molten material under a slightly reducing atmosphere.

2. The method defined in claim 1 wherein said slightly reducing atmosphere is maintained in said region by combustion of fuel with a combustion air ratio of substantially 0.90 to substantially 0.95.

3. The method defined in claim 2, further comprising kneading the material between said surfaces prior to the full solidification thereof.

4. The method defined in claim 2 wherein a cladding of said material is applied only over a central zone of said substrate leaving edge zones thereof unclad by said material.

5. The method defined in claim 2, further comprising the step of briefly contacting said surface of said substrate with a pickling agent and blowing said agent off said surface of said substrate with steam.

6. The method defined in claim 5, further comprising the step of heating said substrate substantially to the temperature of the molten material at said region prior to entry of said substrate into said region.

7. The method defined in claim 6 wherein the cooling of said molten material is effected by directing a stream of a coolant fluid against the underside of said substrate.

8. The method defined in claim 7 wherein said material is lead or copper or an alloy thereof.

9. The method defined in claim 8, further comprising the step of coating said surface of said substrate with tin or a tin-lead alloy before said material, when said material is lead or a lead alloy, is applied to said surface of said substrate.

10. The method defined in claim 8 wherein said substrate is coated with silver solder when said material is copper or copper alloy.

11. The method defined in claim 9 wherein said tin or tin-lead alloy is applied to said substrate by spraying it in the form of a powder suspended in a liquid flux onto said surface of said substrate.

12. An apparatus for cladding a steel strip or steel sheet substrate with a lower melting metal or metal alloy constituting a molten material, said apparatus comprising:

means for cleaning a surface of said substrate;

means defining an inclined path for said substrate with said surface forming an upper surface of said substrate;

an endless belt having a lower pass extending parallel to said upper surface but adjustably spaced therefrom;

means for delivering said molten material to a bank up-stream of said belt and formed on said surface of said substrate;

means in the region of said bank of molten material forming an enclosure maintaining a blanket of slightly reducing gas in the region of contact of said substrate surface with said bank of molten material;

means along said path for cooling the molten material between said lower pass and said surface of said substrate to form a cladding layer on said substrate; and a pair of sliding shoes engaging said substrate and laterally confining said molten material between said pass of said belt and said substrate.

13. The apparatus defined in claim 12, further comprising a pair of sliding shoes engaging said substrate and laterally confining said molten material between said pass of said belt and said substrate.

14. The apparatus defined in claim 12, further comprising means for descaling said substrate by directing steel grit thereagainst, means briefly contacting said surface of said substrate with a pickling agent, and means for directing steam jets against said surface of said substrate to drive said pickling agent from said surface of said substrate, said apparatus further comprising means for heating said substrate and for depositing a mixture of metal or metal alloy powder and a liquid flux on said surface of said substrate to form a primer bonding to said material.

* * * * *